US006783037B1

(12) United States Patent
Bonham

(10) Patent No.: US 6,783,037 B1
(45) Date of Patent: Aug. 31, 2004

(54) LOCKING AEROSOL SPRAY TUBE

(76) Inventor: John E. Bonham, 4633 Saxon Dr., New Smyrna Beach, FL (US) 32169

( * ) Notice: Subject to any disclaimer, the term of this patent is extended or adjusted under 35 U.S.C. 154(b) by 0 days.

(21) Appl. No.: 10/410,983

(22) Filed: Apr. 10, 2003

(51) Int. Cl.[7] ..... B65D 83/00

(52) U.S. Cl. ..... 222/570; 222/402.1; 222/566; 239/337

(58) Field of Search ..... 222/153.09, 402.1, 222/566, 567, 569, 570, 573; 239/337, 338, 346, 600, 587.1

(56) References Cited

U.S. PATENT DOCUMENTS

| | | | | | |
|---|---|---|---|---|---|
| 2,908,446 | A | | 10/1959 | Strouse | |
| 3,116,856 | A | * | 1/1964 | Prussin et al. | 222/402.24 |
| 3,186,645 | A | | 6/1965 | Eberlein | |
| 3,472,457 | A | | 10/1969 | McAvoy | |
| 4,991,750 | A | | 2/1991 | Moral | |
| 5,065,909 | A | * | 11/1991 | Pino et al. | 222/484 |
| 5,242,079 | A | * | 9/1993 | Stephens et al. | 220/705 |
| 5,297,704 | A | | 3/1994 | Stollmeyer | |
| 5,307,964 | A | | 5/1994 | Toth | |
| 5,423,458 | A | | 6/1995 | Tourigny | |
| 5,788,129 | A | | 8/1998 | Markos | |
| 5,873,497 | A | | 2/1999 | Broadus | |
| 5,921,446 | A | * | 7/1999 | Stern | 222/402.1 |
| 6,253,971 | B1 | | 7/2001 | Cobb | |

* cited by examiner

*Primary Examiner*—J. Casimer Jacyna
(74) *Attorney, Agent, or Firm*—John Wiley Horton

(57) ABSTRACT

A modified spray cap and extension tube. Positive mechanical interlocking features are added which lock the extension tube to the cap. The extension tube therefore does not fly out of the cap when in use. The modified spray cap is configured so that a conventional diffused spray pattern is still achieved when the modified extension tube is removed.

4 Claims, 9 Drawing Sheets

LOCKING AEROSOL SPRAY TUBE

BACKGROUND OF THE INVENTION

1. Field of the Invention

This invention relates to the field of aerosol spray cans. More specifically, the invention comprises a revised extension tube that locks to the spray cap when in use.

2. Description of the Related Art

Aerosol spray cans tend to deliver a diffused spray. In some applications, such as the precise deposition of lubricants, this diffused pattern is undesirable. Where precise application is needed, an extension tube has customarily been used.

FIG. 1 shows a prior art aerosol can 10. To dispense its contents, the user pressed down on spray cap 12. A diffused spray pattern then issues from orifice 16. Extension tube 18, which is simply a long hollow piece of plastic, can be inserted into orifice 16. In some prior art devices, orifice 16 is contained within nozzle insert 14. Gripping features, such as small ribs or pliable materials, can be included within nozzle insert 14. These help frictionally retain the portion of extension tube 18 that is thrust into orifice 16. However, those skilled in the art will know that this frictional retention approach is only marginally effective. The contents of aerosol can 10 issue forth under considerable pressure. They may also have significant lubricating value. These two factors degrade the prior art devices' ability to retain extension tube 18 in position. In fact, it is not uncommon for an extension tube 18 to be launched out of spray cap 12 like a projectile.

BRIEF SUMMARY OF THE INVENTION

The present invention comprises a modified spray cap and extension tube. Positive mechanical interlocking features are added which lock the extension tube to the cap. The extension tube therefore does not fly out of the cap when in use. The modified spray cap is configured so that a conventional diffused spray pattern is still achieved when the modified extension tube is removed.

REFERNCE NUMERAL IN THE DRAWINGS

| | | | |
|---|---|---|---|
| 10 | aerosol can | 12 | spray cap |
| 14 | nozzle insert | 16 | orifice |
| 18 | extension tube | 20 | T-cap |
| 22 | cross slot | 24 | T-tube |
| 26 | conduit | 28 | orifice |
| 30 | locking block | 32 | first mating surface |
| 34 | second mating surface | 36 | inlet |
| 38 | tube | 40 | gasket insert |
| 42 | threaded cap | 44 | threaded counterbore |
| 46 | threaded tube | 48 | threaded shank |
| 50 | threaded extension | 52 | delivery tube |
| 54 | spray slot | | |

DETAILED DESCRIPTION OF THE INVENTION

Figure 1:
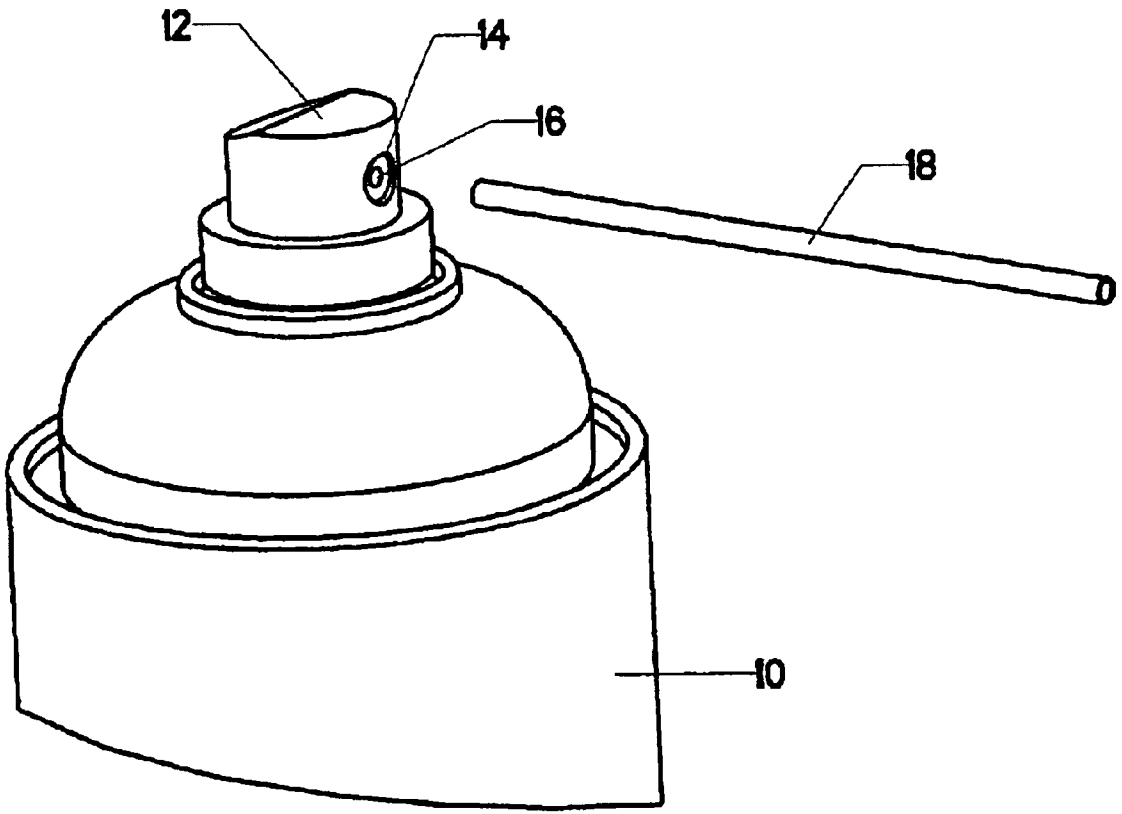
FIG. 1 (PRIOR ART)
FIG. 1 is an isometric view, showing a prior art spray cap and extension tube.
Figure 2:
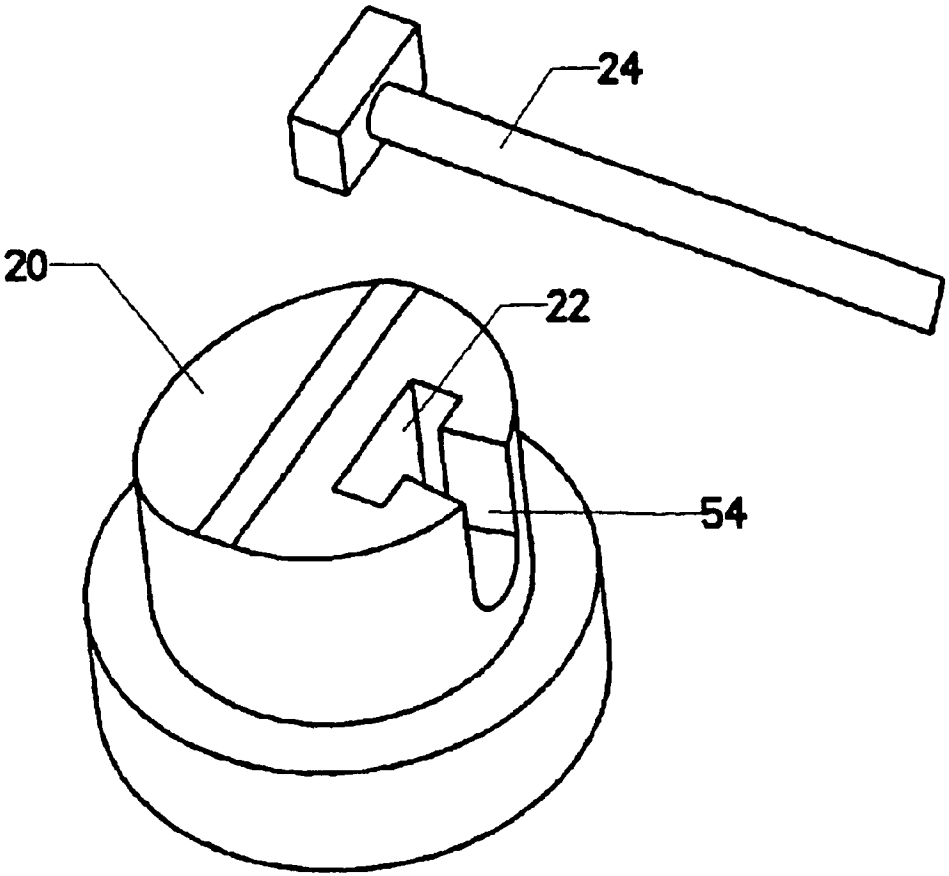
FIG. 2 is an isometric view, showing a modified spray cap and extension tube.

FIG. 2 shows the primary components of the present invention—T-cap 20 and T-tube 24. T-cap 20 generally assumes the same shape as prior art spray cap 12. However, a pair of intersecting slots are cut into its upper surface. These are cross slot 22 and spray slot 54. These two slots combine to form a "T" shape, hence the name T-cap 20. A modified type of extension tube is configured to mechanically interlock with the two slots. The view shows T-tube 24 in position to be installed.

Figure 3:
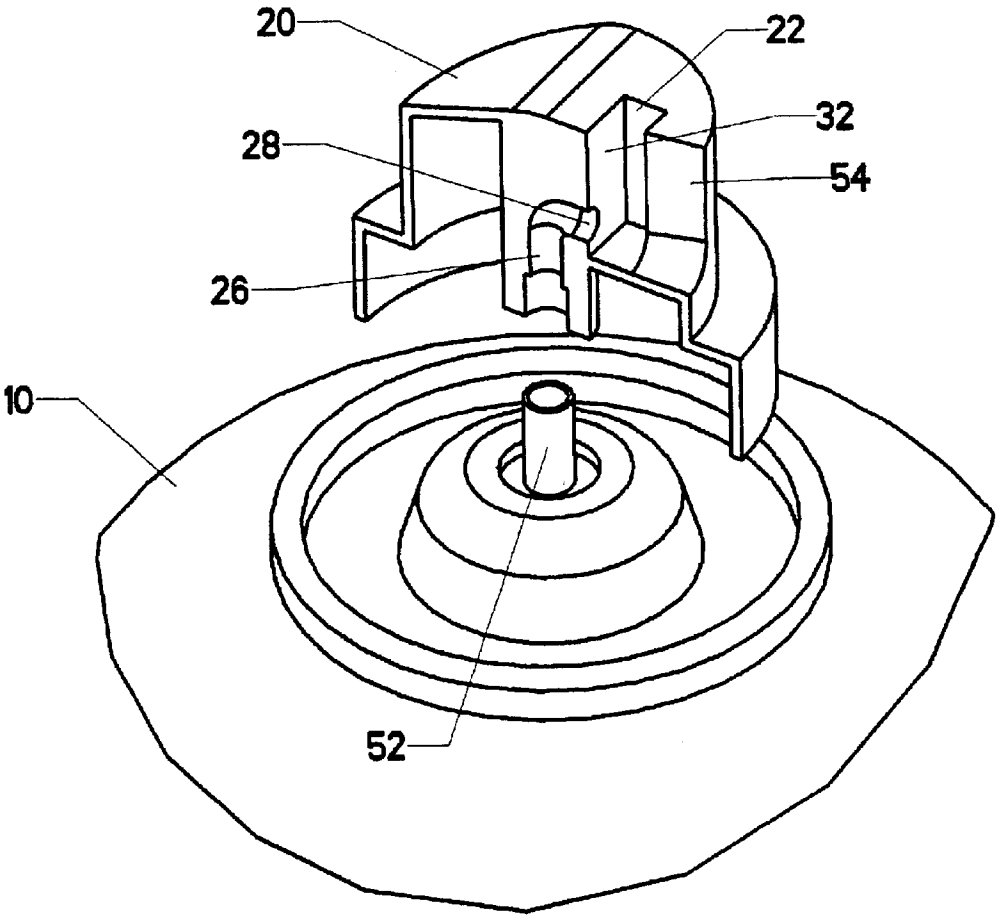
FIG. 3 is an isometric sectional view, showing the internal features of the modified spray cap.

FIG. 3 shows T-cap 20 sectioned in half. It is shown just above the position it would normally occupy when installed on aerosol can 10. Although the particular method of installing T-cap 20 on aerosol can 10 is not significant to the present invention, those skilled in the art will know that one good method of installing such a cap is to press the lower portion of conduit 26 over delivery tube 52.

Delivery tube 52 remains in aerosol can 10. When it is pressed downward, the contents of the can are delivered through the hollow interior of delivery tube 52. When T-cap 20 is installed, the can's contents are delivered through conduit 26, eventually emerging through orifice 28. Orifice 28 is actually located in the rear wall of cross slot 22, which is designated as first mating surface 32 in FIG. 3.

The reader will observe that spray slot 54 is aligned with orifice 28. This fact is significant since the device preferably functions well without the use of an extension tube. In other words, the user preferably has the option of a diffused spray available without an extension tube, or a focused spray available with the extension tube. To that end, the side walls of spray slot 54 preferably diverge somewhat so as not to interfere with the spray pattern when T-tube 24 is not in use.

Figure 4:
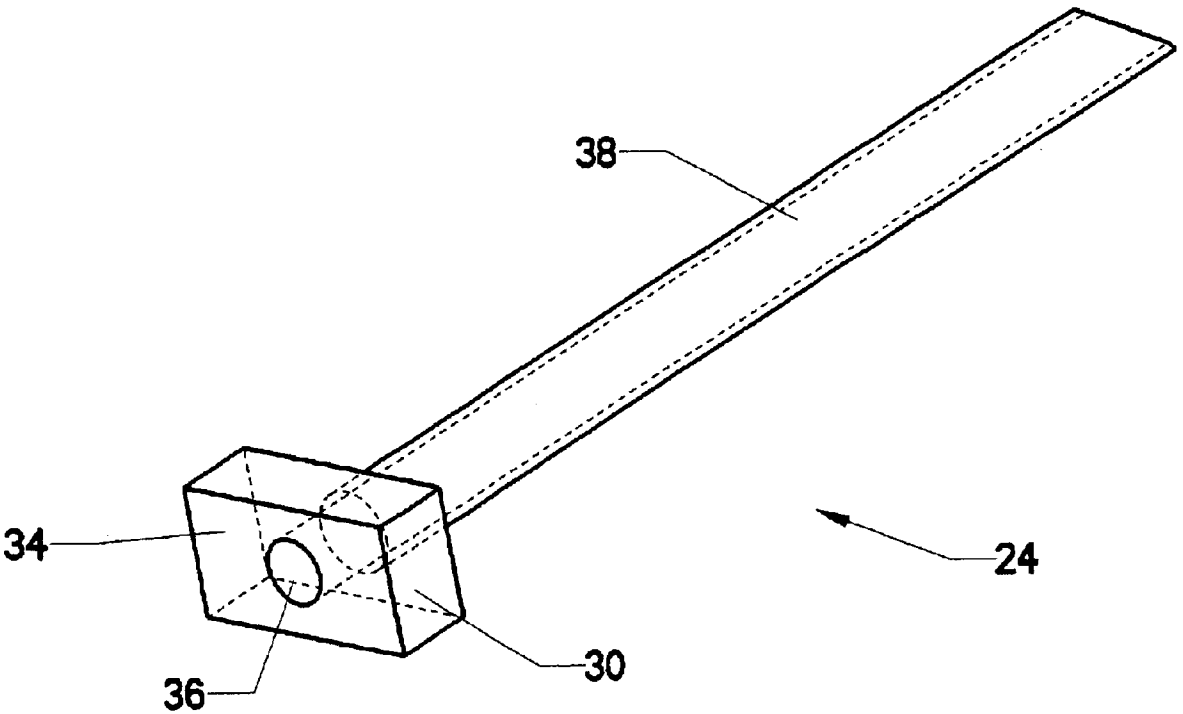
FIG. 4 is a hidden line view, showing the modified extension tube.

FIG. 4 shows the portion of T-tube 24 which is configured to lock into T-cap 20 in more detail. Locking block 30 is a rectangular piece which is attached to the hollow tube 38. Inlet 36 is located on second mating surface 34. It passes through locking block 30 to connect with the hollow interior of tube 38. The reader will observe by studying the geometry that when T-tube 24 is pressed into T-cap 20, second mating surface 34 will mate snugly with first mating surface 32 (assuming that locking block 30 is properly sized with respect to cross slot 22). The height of locking block 30 is selected so that when its lower surface mates against the lower surface of cross slot 22, inlet 36 will be aligned with orifice 28. Tube 38 will then lie within spray slot 54.

Figure 5:
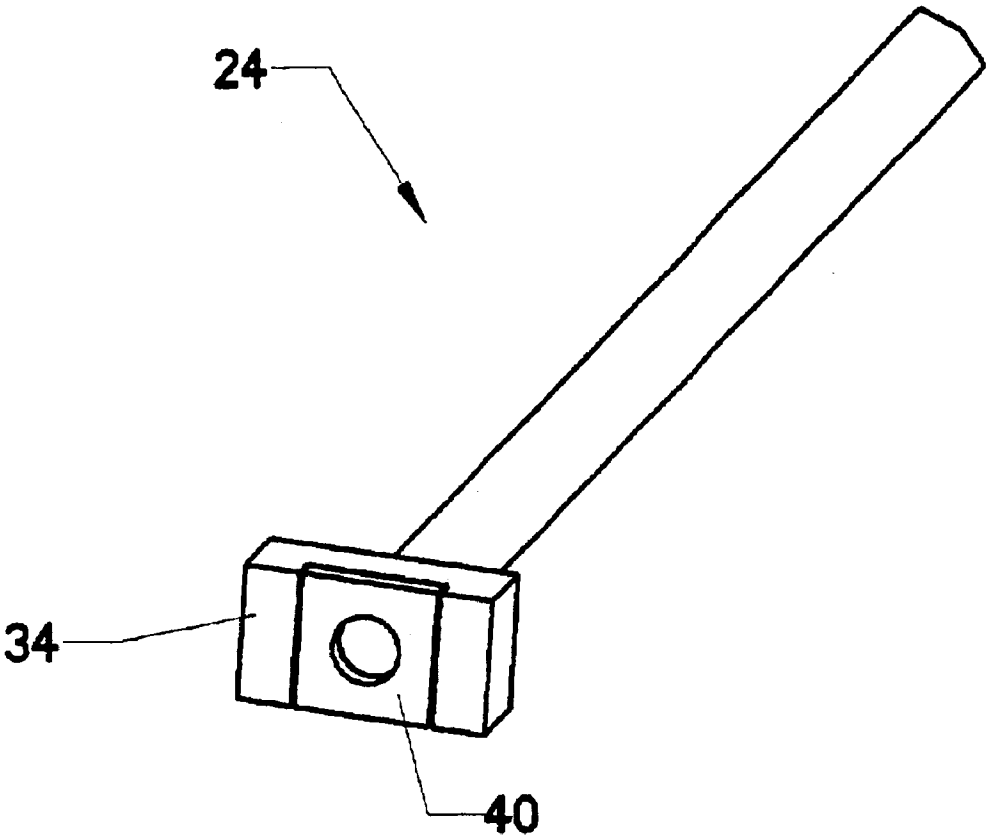
FIG. 5 is an isometric view, showing an alternate embodiment of the modified extension tube.
Figure 5B:
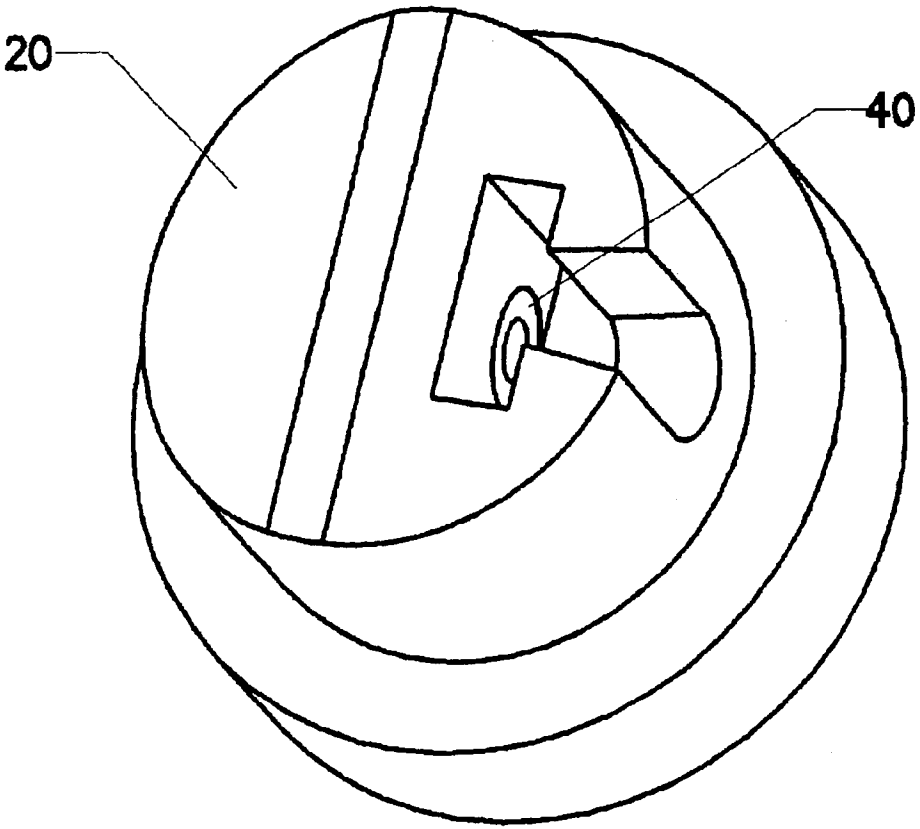
FIG. 5B is an isometric view, showing an alternate embodiment of the modified spray cap.

Second mating surface 34 bears against first mating surface 32 so that when the user presses T-cap 20, the contents of aerosol can 10 will flow from orifice 28 into inlet 36 without unwanted leakage. However, for certain lowviscosity solvents, the mating of the two surfaces alone may be insufficient. FIG. 5 shows the addition of gasket insert 40 to second mating surface 34. Gasket insert 40 is preferably made of a pliable sealing material which helps form a tight seal between orifice 28 and inlet 36. A sealing gasket can also be placed on T-cap 20. FIG. 5B shows an alternate version of T-cap 20 in which a gasket insert 40 has been added around orifice 28.

Figure 6:
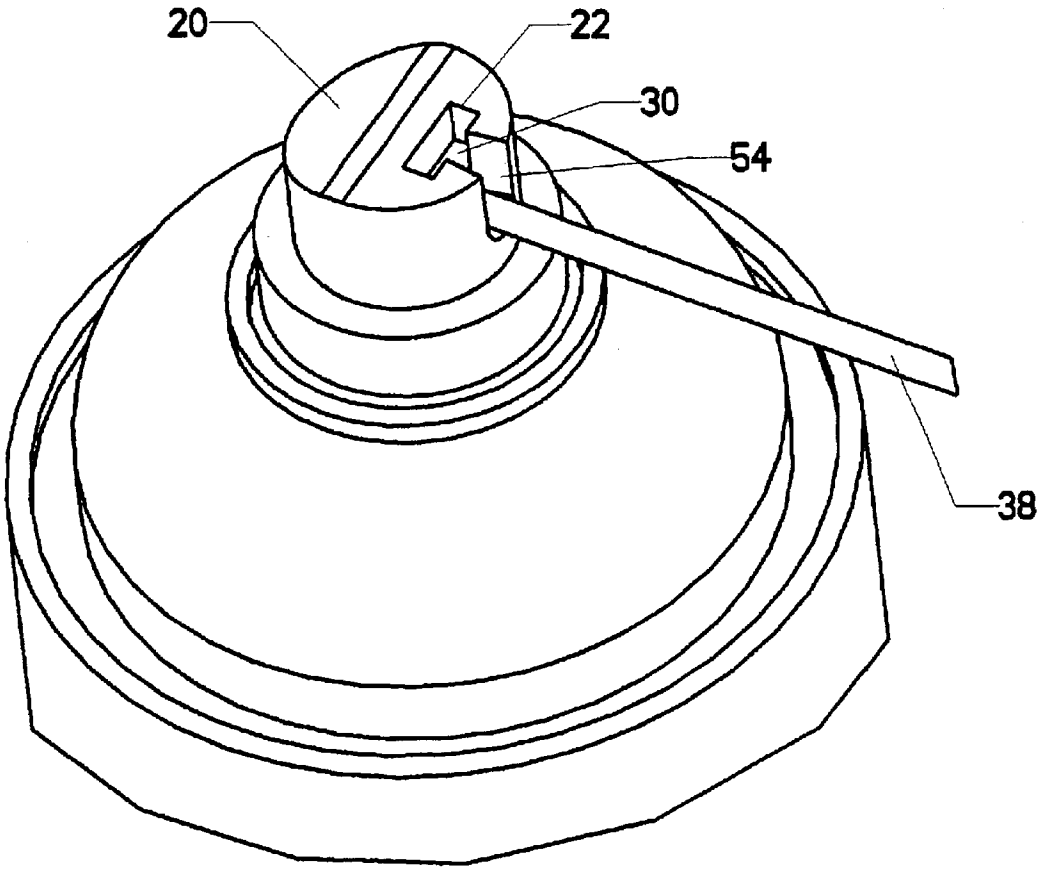
FIG. 6 is an isometric view, showing the modified extension tube locked into the modified spray cap.

FIG. 6 shows the completed assembly, with T-tube 24 mechanically locked to T-cap 20. The reader will observe how locking block 30 rests within cross slot 22 and how tube 38 rests within spray slot 54. In this configuration, the user may freely employ tube 38 without fear of it coming loose from T-cap 20. The user is also free to use the can with a more conventional diffused spray by simply removing T-tube 24. It easily presses into place and it is just as easily removed.

Figure 7:
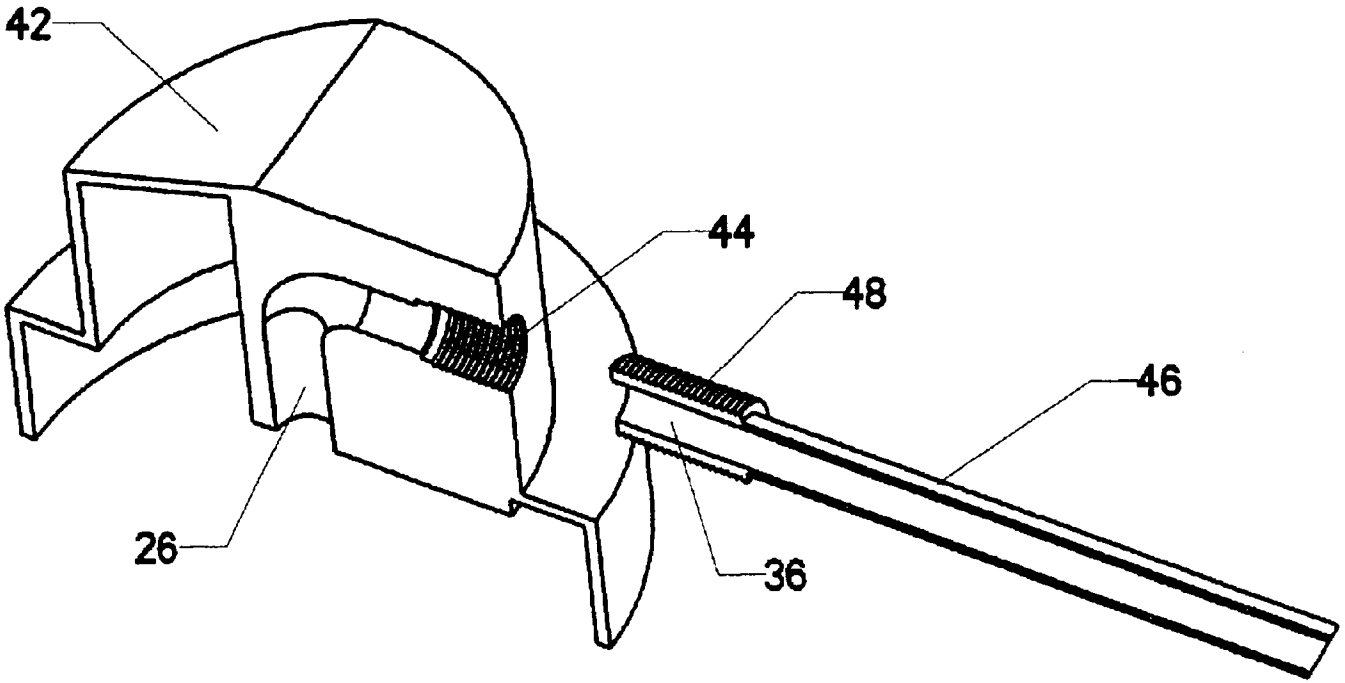
FIG. 7 is an isometric sectional view, showing an alternate embodiment of the present invention.

FIG. 7 shows other mechanical interlocking means which can be used to lock the extension tube to the cap. Conduit 26 passes through threaded cap 42, bends 90 degrees, and exits at a point on the cap's perimeter. Threaded counterbore 44 is provided at this point of exit. Threaded tube 46 is substituted for T-tube 24. It has threaded shank 48, which features a male thread sized to engage the female thread within threaded counterbore 44. Inlet 36 passes through threaded shank 48 and connects to the hollow interior of the extension tube. In this embodiment, the user installs the extension tube by threading threaded shank 48 into threaded counterbore 44, and removes it by unthreading threaded shank 48 from threaded counterbore 44. Both components are shown sectioned in half in order to aid visualization.

Figure 8:
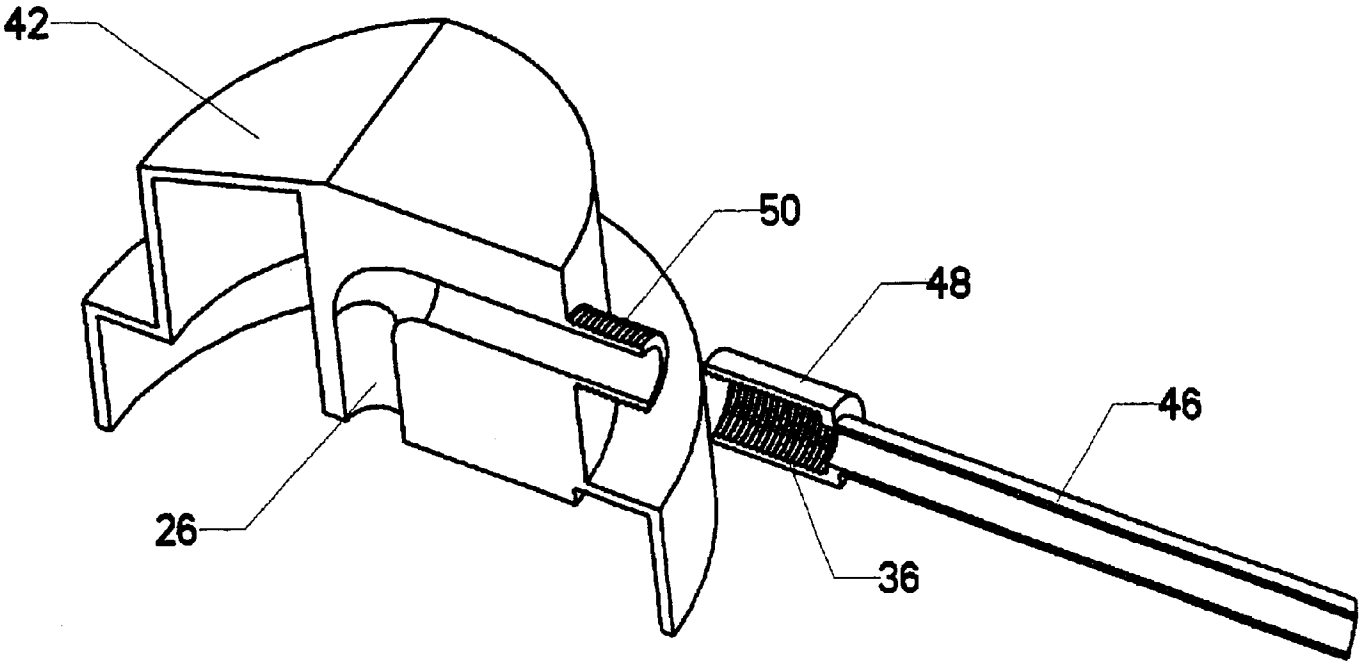
FIG. 8 is an isometric sectional view, showing an alternate embodiment of the present invention.

An alternate embodiment is shown in FIG. 8. Threaded extension 50 extends from the cap's perimeter at the point where conduit 26 exits. Threaded extension 50 features a male thread. An alternate embodiment of threaded tube 46 is also provided. In the version shown in FIG. 8, threaded shank 48 features a female thread along the wall of inlet 36. This female thread is sized to engage the male thread on threaded extension 50. Its operation is the same as for the embodiment shown in FIG. 7; i.e., the user installs and removes the extension tube using the threaded engagement.

The preceding description contains significant detail regarding the novel aspects of the present invention. It is should not be construed, however, as limiting the scope of the invention but rather as providing illustrations of the preferred embodiments of the invention. As an example, many shapes could be employed for cross slot 22, spray slot 54 and locking block 30. They are not limited to the orthogonal walls shown, but could instead be elliptical in shape. Such a variation would not alter the function of the invention. Thus, the scope of the invention should be fixed by the following claims, rather than by the examples given.

Having described my invention, I claim:

1. A locking extension tube assembly allowing a user to lock an extension tube to an aerosol spray can, wherein said aerosol spray can includes a delivery tube which, when pushed downward, delivers the contents of said aerosol spray can therethrough, comprising:

a. a cap, having an upper portion and a lower portion, positioned over said delivery tube, including
   i. a cross slot;
   ii. a conduit, beginning at said lower portion of said cap directly over said delivery tube and ending in an orifice in said cross slot;
   iii. a spray slot, intersecting said cross slot and aligned with said orifice;

b. a T-tube, including
   i. a locking block, sized to fit securely within said cross slot;
   ii. a tube, having a hollow interior, attached to said locking block;
   iii. an inlet passing through said locking block and connecting with said hollow interior of said tube;
   iv. wherein said inlet is position so that when said user places said T-tube into said cap by pressing said locking block into said cross slot, said inlet will align with said orifice; and
   v. wherein said tube is attached to said locking block in a position so that when said locking block is pressed into said cross slot, said tube lies within said spray slot.

2. A locking extension tube assembly as recited in claim 1, wherein:

a. said cross slot includes a first mating surface;
b. said orifice lies on said first mating surface;
c. said locking block includes a second mating surface;
d. said inlet lies on said second mating surface; and
e. when said locking block is pressed into said cross slot, said second mating surface bears against said first mating surface in order to seal said inlet to said orifice.

3. A locking extension assembly as recited in claim 2, wherein said second mating surface includes a gasket insert.

4. A locking extension assembly as recited in claim 2, wherein said first mating surface includes a gasket insert.

* * * * *